US007127203B1

(12) United States Patent
Pitts

(10) Patent No.: US 7,127,203 B1
(45) Date of Patent: Oct. 24, 2006

(54) FUSER MEMBER WITH REINFORCED SLOT

(75) Inventor: Ian Pitts, Cambs (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/220,175

(22) Filed: Sep. 6, 2005

(51) Int. Cl.
*G03G 15/20* (2006.01)

(52) U.S. Cl. ..... 399/328; 399/320

(58) Field of Classification Search ..... 399/328
See application file for complete search history.

(56) References Cited

U.S. PATENT DOCUMENTS 5,687,297 A 11/1997 Coonan et al.
6,069,624 A 5/2000 Dash et al.
6,393,248 B1 * 5/2002 Tsurusaki et al. ..... 399/330
6,745,000 B1 6/2004 Pirwitz
6,963,719 B1 * 11/2005 Jaskowiak ..... 399/333
6,983,118 B1 * 1/2006 Jaskowiak et al. ..... 399/330
2005/0129433 A1 6/2005 Jaskowiak et al.
2005/0129435 A1 6/2005 Jaskowiak

* cited by examiner

*Primary Examiner*—David M. Gray
*Assistant Examiner*—Bryan Ready
(74) *Attorney, Agent, or Firm*—Eugene O. Palazzo; Fay, Sharpe, Fagan, Minnich & McKee, LLP

(57) ABSTRACT

A fuser member includes a metallic core cylinder with an axially extending slot defined in an end region of the core cylinder. An integral flange is formed from material from the slot. The flange extends generally radially from the core cylinder adjacent the slot. A drive gear includes a key. The slot receives the key for rotation of the core cylinder.

20 Claims, 4 Drawing Sheets

FUSER MEMBER WITH REINFORCED SLOT

BACKGROUND

The present exemplary embodiment relates generally to a fusing system for fusing marked media and more particularly to a fuser member with a reinforced slot for accepting a drive gear.

Fuser rolls used in electrographic imaging systems generally comprise a metal core cylinder coated with one or more elastomer layers. The fuser roll is heated, either internally or externally, to provide a heated exterior surface for fusing marking materials, such as toners, to paper or other marking media. Conventional fuser roll core cylinders are relatively thick-walled aluminum alloy cylinders. The thickness has been employed in order to provide strength and durability as the fuser roll presses against the adjacent compression roll in the nip region.

Typically, the fuser roll is allowed to cool between fusing operations to conserve energy and prolong the life of the fuser roll. The warm-up time of a fuser roll depends on its mass. It is desirable for the fuser roll to reach an operating temperature of about 150–200° C. within a relatively short period of time using conventional power sources. In order to save energy and shorten warm-up times, the fuser roll wall thickness has been progressively reduced. However, it has been found that the thinner cylinder walls are subject to weakness and cracking, particularly in the end region of the cylinder where a drive slot is punched out of the fuser core cylinder. The drive slot receives a key of a drive gear for rotation of the core cylinder. As the fuser roll rotates, the pressure placed on the fuser roll at the nip tends to cause the fuser roll to be slightly out of round. The slot acts as a stress raiser. Cracks may propagate from the slot, ultimately causing the failure of the fuser roll.

Various attempts have been made to strengthen the slot. In one method, a rib is mounted to the fuser roll in the region of the slot.

CROSS REFERENCE TO RELATED PATENTS AND APPLICATIONS

The following applications, the disclosures of which are incorporated herein in their entireties, are mentioned:

Published Application No. 2005/0129433 by Jaskowiak discloses a thin walled fuser roll with a radial slot at its terminus for redirecting axial stress in a radial direction.

Published Application No. 2005/0129435 by Jaskowiak discloses a thin walled fuser roll with a slotless keyway.

BRIEF DESCRIPTION

Aspects of the exemplary embodiment relate to a fuser member and to a method of forming a fuser member. The fuser member includes a metallic core cylinder including an axially extending slot defined in an end region of the core cylinder. An integral flange is formed from material from the slot which extends generally radially from the core cylinder adjacent the slot. A drive gear includes a key. The slot receives the key for rotation of the core cylinder.

In another aspect, the method for forming a fuser member includes forming a channel in an end region of a metallic core cylinder. A flange is formed from material of the core cylinder adjacent the channel to define an axially extending slot in the end region of the core cylinder. A drive gear is mounted to the core cylinder whereby the slot receives a key of the drive gear.

In another aspect, a fuser member includes a metallic core cylinder including a slot extending axially from an end of the core cylinder. A flange extends generally radially inward from the core cylinder along three sides of the slot to define opposed faces. A drive gear having an inside diameter sleeve for fitting over the core member includes a key. The slot receives the key for rotation of the core cylinder.

DETAILED DESCRIPTION

Figure 1:
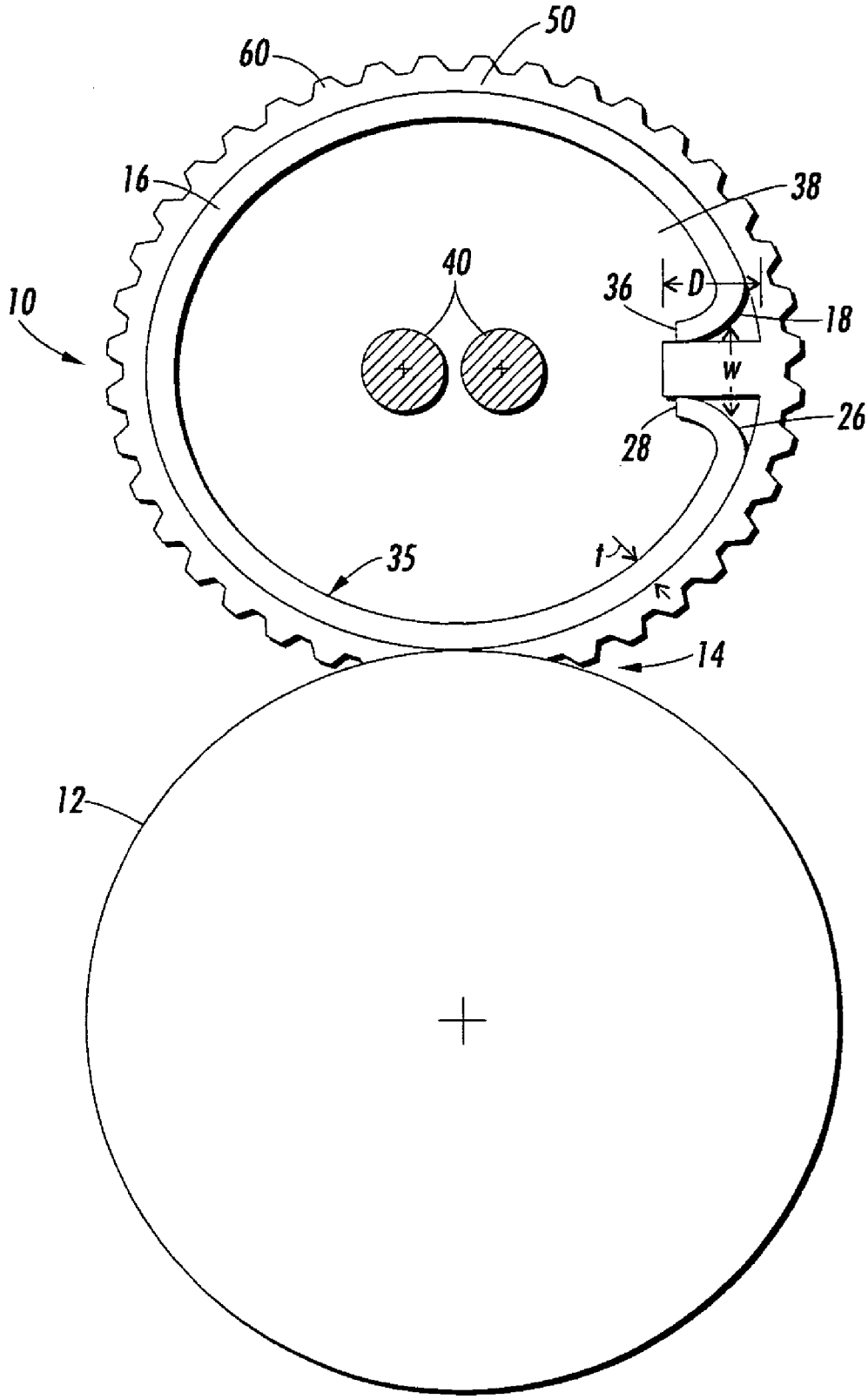
FIG. 1 is cross sectional view of a fusing system comprising a thin walled fuser member according to the exemplary embodiment.

In aspects of the exemplary embodiment disclosed herein, a fuser member core cylinder includes an axial slot for receiving a key of a drive gear. The slot has a flange formed at its perimeter from material which would otherwise be thrown away when a slot is punched from the core cylinder. This material is used to define the perimeter of the slot by bending the material inward to define a lip having opposed engagement faces for engaging the key during rotation. The engagement faces extend radially inward and provide a reinforcement to the slot which resists cracking of the fuser member core during operation of the fuser member. The reinforcement enables an otherwise thin-walled core cylinder to be produced which provides energy efficiency and fast warm-up times while meeting or exceeding specifications for durability and imaging performance. A fusing system incorporating the core cylinder can have warm up times of less than one minute, for example, of about thirty seconds or less. The reinforcement provides strength to the core cylinder wall proximate to the slot sufficient to prevent cracking from repeated cyclic compression. The reinforced slot offers a more positive engagement for a plastic drive gear key than other known systems as it provides a face to take the torque loading that is at right angles to the direction of the torque.

The fusing system thus described may form a part of an imaging system, such as a printer or copier, or a multifunction device, such as a printer with print, copy, scan, and fax services. Such multifunctional printers are well known in the art and may comprise print engines based upon electrophotography, ink jet, or other imaging methods. In an electrographic (xerographic) process, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper or other image support substrate. The fusing of the toner onto the paper is generally accomplished by applying heat to the toner with a heated roller and application of pressure. In the fusing process, the toner image is permanently affixed to the print medium for producing a reproduction of the original document. The fuser member of the exemplary embodiment is suited to use in such an electrographic apparatus for this process. In a final step in the process, the photoconductive surface layer of the photoreceptive member is cleaned to remove any residual developing material therefrom, in preparation for successive imaging cycles.

The above described electrographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Electrographic imaging technology is described, for example, in U.S. Pat. No. 6,069,624 to Dash, et al. and U.S. Pat. No. 5,687,297 to Coonan et al., both of which are hereby incorporated herein by reference in their entireties.

With reference to FIG. 1, a fusing system includes a fuser member 10 and a pressure member 12 which define a nip 14 therebetween. Pressure is applied to the fuser member by the pressure member during passage of print media through the nip. The fuser member 10 includes a core cylinder 16, such as a metallic core cylinder formed from aluminum, an alloy thereof, steel, or other suitable metal. The core cylinder has a wall thickness t, in the radial direction, of between about 0.5 millimeters and about 2.0 millimeters. In one specific embodiment, the wall thickness t is about 1.1. mm and the outside diameter of the core cylinder 16 is about 35.0 mm.

Figure 2:
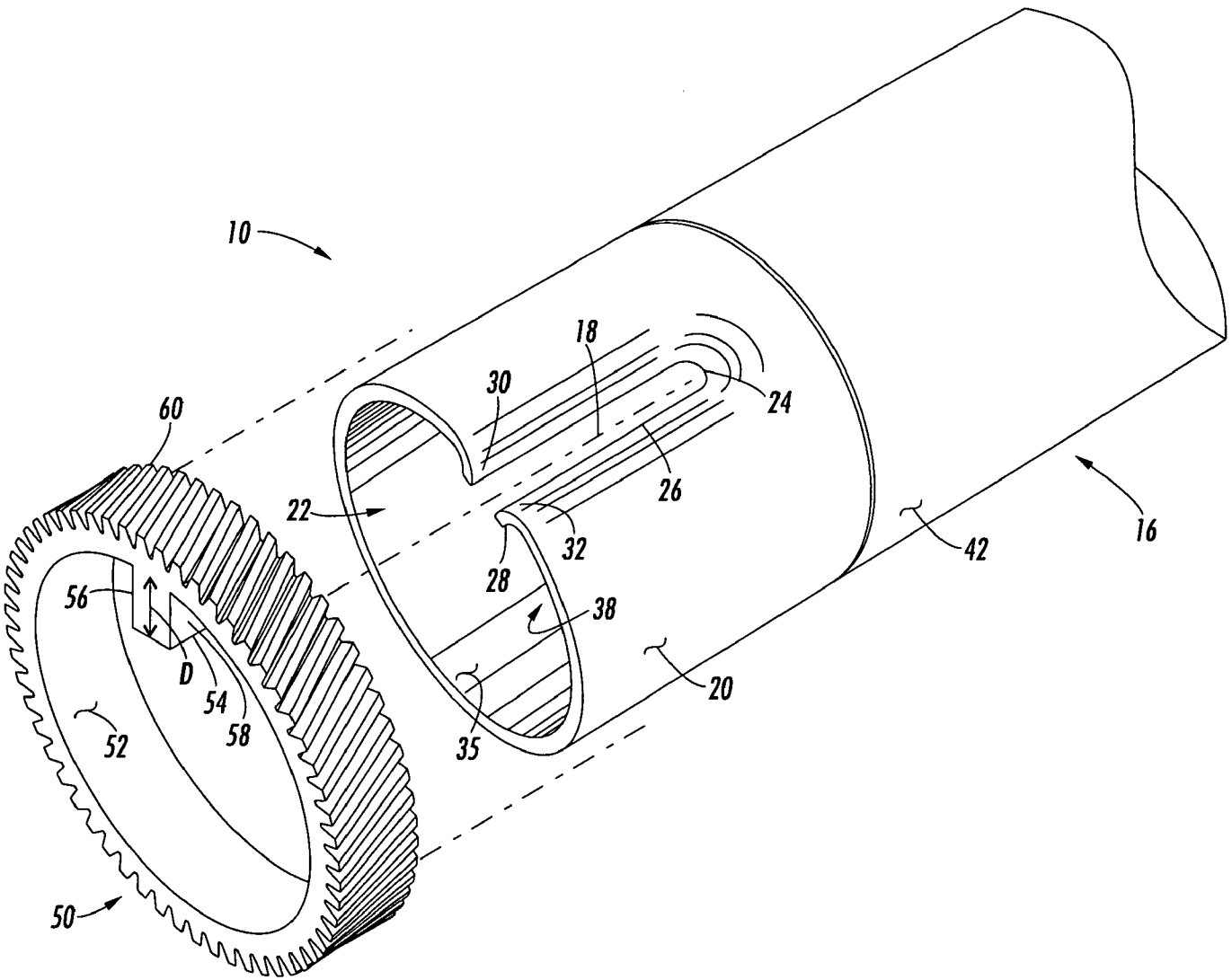
FIG. 2 is an exploded perspective view of the thin-walled fuser member and drive gear of the fusing system of FIG. 1.
Figure 3:
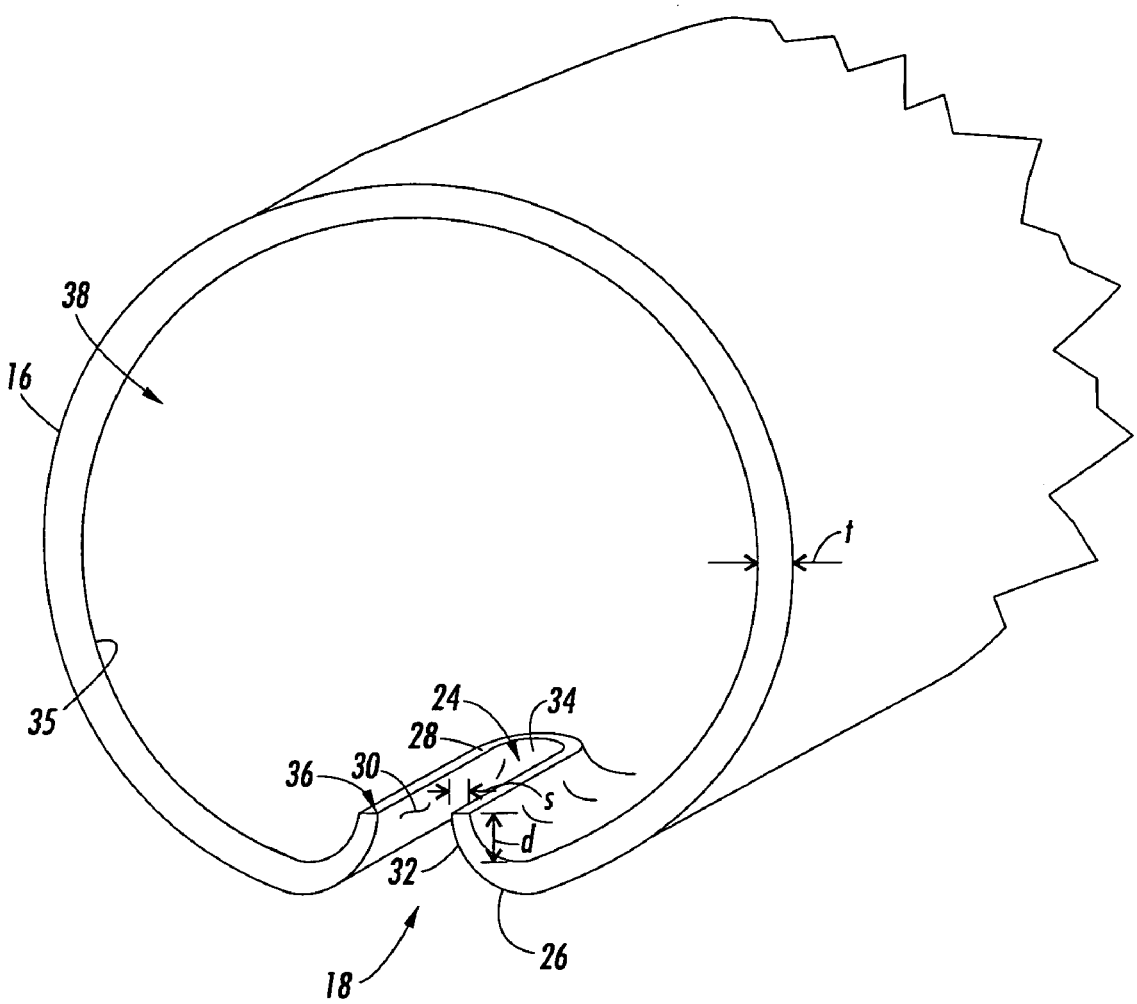
FIG. 3 is a cross sectional view of the thin-walled fuser member of the fusing system of FIG. 2.

With reference also to FIG. 2, one or more slots 18 are formed in an end region 20 of the core member. In the embodiment of FIG. 1, a single slot is shown, however more slots may be provided, such as two, four, or six slots. The slot 18 extends generally axially from a first open end 22 of the core cylinder to a terminus 24, spaced from the end 22. A perimeter 26 of the slot is defined by a flange or side wall 28, which extends generally radially inward from the core cylinder 16. As best shown in FIG. 3, where only a single slot is illustrated, the flange may extend along three sides of the slot, in a U-shape, to provide a lip to the core cylinder around the perimeter 26 of the slot 18. The side wall 28 thus provides opposed engagement faces 30, 32 joined by a terminal portion 34 with a radiused end surface adjacent the terminus 24 of the slot. The slot 18 thus provides a passage through the core cylinder 16 which is open adjacent interior and exterior surfaces of the core cylinder.

Since the side wall 28 is formed from the material which occupied the slot prior to formation of the slot (the "slot material"), the depth d of the flange 28 which extends beyond an interior surface 35 of the cylinder 16 can be up to about half the maximum width w of the slot (FIG. 1). This provides the core 16 cylinder with an increased thickness region of height (d+t) at the perimeter 26 of the slot without the need to add additional material. The depth d can be at least 1 mm, e.g., at least equal to the thickness t of the wall. For example, for a slot of width w of about 4–6 mm the depth d of the flange may be about 1.0–2.5 mm. This provides a face 30, 32 having a height (d+t) of e.g., about 2.0–4 mm. In one embodiment, the height (d+t) is at least 2.2 mm. It will be appreciated that because of the curvature of the flange, its height (d+t) may be somewhat less than the theoretical height based on the dimensions of the slot material from which it is formed. The 28 flange may be radiused, as shown in FIGS. 1 and 3, such that the slot 18 decreases in width away from the cylinder wall 16. The slot 18 may have an hourglass shape, i.e., the width increasing again towards a distal end 36 of the flange 28. The convex shape of the flange 28 provides an efficient stress reducer when the core cylinder 16 is compressed by the pressure roll 12.

The slot 18 provides a through passage into an interior 38 of the core cylinder 16. The side wall 28 can be formed by bending the slot material without appreciable stretching of the slot material or the adjacent material of the core cylinder, resulting in the side wall having a wall thickness which is comparable to that of the average core cylinder wall thickness t in the end region.

The illustrated core cylinder 16 is heated by a heater 40 (FIG. 1), such as one or more halogen lamps located in the interior 38 of the core cylinder 16. Alternative heaters are contemplated, such as external induction heaters or lamps, or the like. The core member 16 may be coated with one or more exterior conformable layers 42 (FIG. 2), such as a layer of silicone rubber and may be protected by an outer layer of Teflon™.

In operation, a drive gear 50 (FIG. 2) having an internal diameter sleeve 52 is fitted over the end region 20 of the core cylinder 16 such that a key 54 of the drive gear extends through the slot 18. One or both of opposed side faces 56, 58 of the key 54 engage one or both of the engagement faces 30, 32 for forcing rotation of the core cylinder 16. The key may have a depth D which is greater than the depth d of the slot and thus the key may extend radially inward of the side wall 28, as shown in FIG. 1. The drive gear 50 may be formed from plastic or other suitable material. While an exterior drive gear 50, as shown, conveniently allows the heating lamps to be inserted into the core cylinder 16 after mounting the drive gear to the core cylinder, the drive gear may alternatively be configured for slotting within the core cylinder with an exterior key protruding through the slot toward an exterior of the core cylinder.

Rotation of the fuser member 10 is effected by engagement of exterior teeth 60 of the drive gear 50 with a drive mechanism (not shown) that forces the gear 50 to turn. The sleeve 52 comprises the internal diameter of the gear 50 with the result that the sleeve 52 is also driven upon engagement of the teeth 60. The key 54 engages the flange 28 of the slot 18 in order that the core cylinder 16 is driven by the drive gear 50. As the fuser member 10 turns, print substrates are caught in the nip 14 between the core cylinder and the adjacent pressure roll 12 and are pulled and guided over and past the fuser member 10. Since the fuser member is heated to fusing temperature, the result is fusing the toner to the copy substrate by at least partially melting the toner under pressure.

Figure 4:
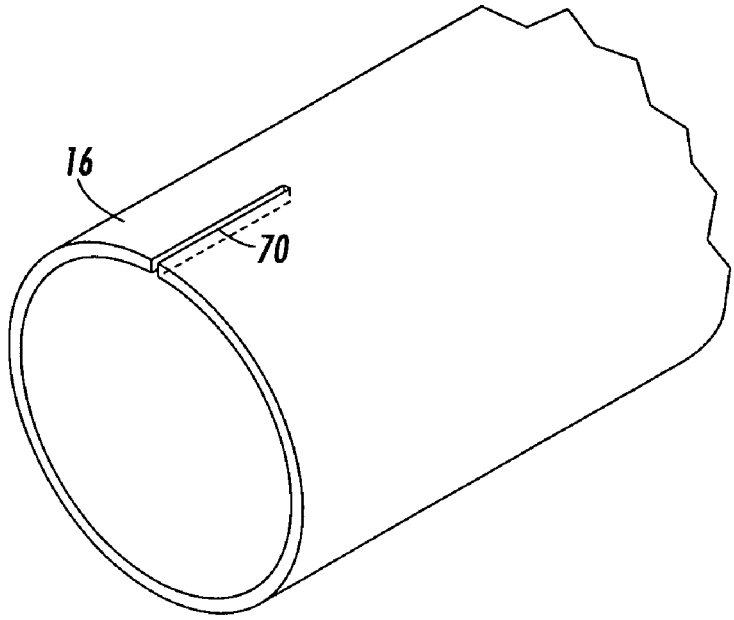
FIGS. 4–5 illustrate steps in the formation of the fuser member core cylinder.
Figure 5:
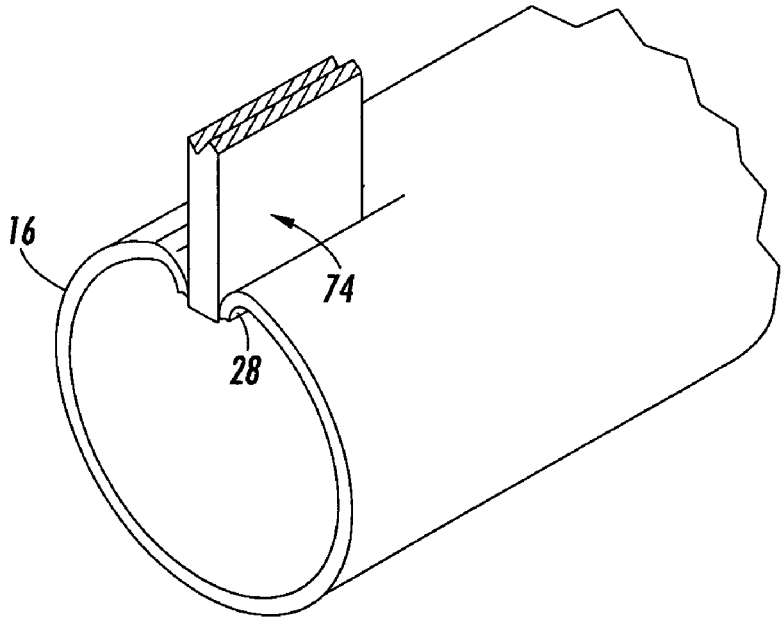

With reference to FIGS. 4 and 5, the slot or slots 18 can be formed in the core cylinder 16 by forming a channel 70 using a saw, laser cutting device, or the like. The channel 70 can be of any suitable width, depending on the width of the blade or other cutting member of the tool used to form the channel. For example the channel 70 may be about 1–2 mm, although laser cutting tools may result in a narrower channel. The channel 70 is narrower in width than the width w of the subsequently formed slot 18, e.g., the width of the channel 70 is at least 2 mm less than that of the slot 18 and can be up to about 6 mm (or greater) less than the slot width w. For example, for a slot having a width w of 6 mm, the channel may be about 4–5 mm less e.g., about 1–2 mm. It is this difference in width that is used to form the flange 28.

The channel 70 has a length which is the approximate length of the slot, e.g., about 20 mm. A suitable tool 74 can be used to punch the wall of the core cylinder radially inward, around the edge of the channel 70, to form the flange 28.

While the flange is shown as extending on both sides of the slot 18, in an alternative embodiment, the flange 28 is formed only or primarily on one side of the slot, that side being the one which lies in the direction of rotation of the core cylinder and which is engaged when the key 54 is inserted in the slot.

The fuser member thus described has a significantly longer lifetime than comparable fuser members formed without the flange. From tests on the fuser member, it is anticipated that a face height (d+t) of about 2.2 mm, or greater, is expected to provide a core cylinder which lasts for the useful life of other components of the fuser member.

Without intending to limit the scope of the exemplary embodiment, the following example demonstrates the effectiveness of the flange 28 in increasing the lifetime of a fuser member.

EXAMPLE

A fuser member was formed by milling four channels of about 1 mm in width, equally spaced around an aluminum core cylinder of wall thickness 1.1 mm. The material around the channels was bent inward to create four slots, each with a flange around the slot. The flange had a height (d+t) of about 2.5 mm. The core cylinder was fitted with a gear having four keys which were fitted into respective slots. The fuser member was installed in an imaging device and heated to an operating temperature of 188° C. The fuser roll was run constantly without cycling down the temperature. Fuser rolls formed with slots without a flange were tested under similar conditions. The number of revolutions of the fuser member until the first crack in the core cylinder appeared was determined and the number of revolutions to complete failure were also noted. Most of the conventional fuser rolls tested exhibited a first crack within 1,000,000 revs. The average time to the first crack of the conventional rolls was less than about 500,000 revs. Some of these fuser rolls exhibited a complete failure during the test (12,000,000 revs). In the case of the fuser member formed according to the exemplary embodiment, however, no cracks were observed prior to ending the test at 12,000,000 revs.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fuser member comprising:

a metallic core cylinder including an axially extending slot defined in an end region of the core cylinder, the slot providing a through passage into an interior of the core cylinder, an integral flange formed from material from the slot extending generally radially from the core cylinder adjacent the slot; and a drive gear including a key, the slot receiving the key for rotation of the core cylinder.

2. The fuser member of claim 1, wherein the core cylinder has a wall thickness between about 0.5 millimeters and about 2.0 millimeters.

3. The fuser member of claim 1, wherein the flange defines opposed faces for engaging the key.

4. The fuser member of claim 3, wherein the opposed faces are convex.

5. The fuser member of claim 3, wherein the flange has a radiused terminus intermediate the opposed faces which defines a distal end of the slot.

6. The fuser member of claim 1, wherein the flange extends radially inward from the core cylinder.

7. The fuser member of claim 1, wherein the flange extends along three sides of the slot.

8. The fuser member of claim 1 further comprising a conformable layer disposed on the core cylinder.

9. The fuser member of claim 1, wherein the flange extends radially from the cylinder wall by at least about 0.5 mm in a region adjacent the key.

10. The fuser member of claim 1, wherein the flange extends radially from the cylinder wall by at least about 0.5 mm around three sides of the slot.

11. The fuser member of claim 1, wherein the flange has a depth of less than half a width of the slot.

12. The fuser member of claim 1 wherein the key extends radially inward of the slot.

13. A fusing system comprising the fusing member of claim 1, the fusing system further comprising a pressure roll, the core cylinder and the pressure roll defining a nip therebetween.

14. A xerographic system comprising a marking engine for applying an image to print media, the marking engine further comprising the fusing system of claim 13.

15. A method for forming a fuser member comprising:

forming a channel in an end region of a metallic core cylinder;

thereafter forming a flange from material of the core cylinder adjacent the channel to define an axially extending slot in the end region of the core cylinder; and mounting a drive gear to the core cylinder whereby the slot receives a key of the drive gear.

16. The method of claim 15, wherein the flange is formed by bending the material of the core cylinder radially inward.

17. The method of claim 15, wherein the flange is formed with opposed faces for engaging the key.

18. The method of claim 15, further comprising forming a conformable layer on the core cylinder.

19. A fuser member comprising:

a metallic core cylinder including an slot extending axially from an end of the core cylinder;

a flange extending generally radially inward from the core cylinder along three sides of the slot to define opposed faces; and a drive gear comprising an inside diameter sleeve for fitting over the core member, the drive gear including a key, the slot receiving the key therethrough for rotation of the core cylinder.

20. The fuser member of claim 19, wherein the flange is integrally formed with the metallic core cylinder.

* * * * *